US010907108B1

(12) United States Patent
Kong et al.

(10) Patent No.: US 10,907,108 B1
(45) Date of Patent: Feb. 2, 2021

(54) METHOD FOR REMOVING SULFUR-CONTAINING CONTAMINANTS FROM A THERMALLY CRACKED WASTE OIL

(71) Applicants: Jake S J Kong, Honolulu, HI (US); Charlie Jeong, Lacombe (CA)

(72) Inventors: Jake S J Kong, Honolulu, HI (US); Charlie Jeong, Lacombe (CA)

( * ) Notice: Subject to any disclaimer, the term of this patent is extended or adjusted under 35 U.S.C. 154(b) by 14 days.

(21) Appl. No.: 16/532,649

(22) Filed: Aug. 6, 2019

(51) Int. Cl.
*C10G 53/04* (2006.01)
*C10G 53/08* (2006.01)

(52) U.S. Cl.
CPC ..... *C10G 53/04* (2013.01); *C10G 53/08* (2013.01); *C10G 2300/1007* (2013.01); *C10G 2300/202* (2013.01)

(58) Field of Classification Search
None
See application file for complete search history.

(56) References Cited

U.S. PATENT DOCUMENTS 3,864,242 A * 2/1975 Watanabe ..... C10G 1/006 208/180
9,555,342 B2 * 1/2017 Wheeler ..... C10B 31/12
2018/0117561 A1 * 5/2018 Brucato ..... C10J 3/78

* cited by examiner

*Primary Examiner* — Tam M Nguyen
(74) *Attorney, Agent, or Firm* — NSIP Law

(57) ABSTRACT

A method for removing sulfur containing contaminants from a thermally cracked waste oil is disclosed. In the present invention, the substantial amount of contaminants containing sulfur is separated into a solvent and further remaining contaminants can be separated via adsorption with bauxite such that an end product oil having better quality may be produced with higher productivity. The solvent can be subject to flash evaporation and then be recycled.

18 Claims, 1 Drawing Sheet

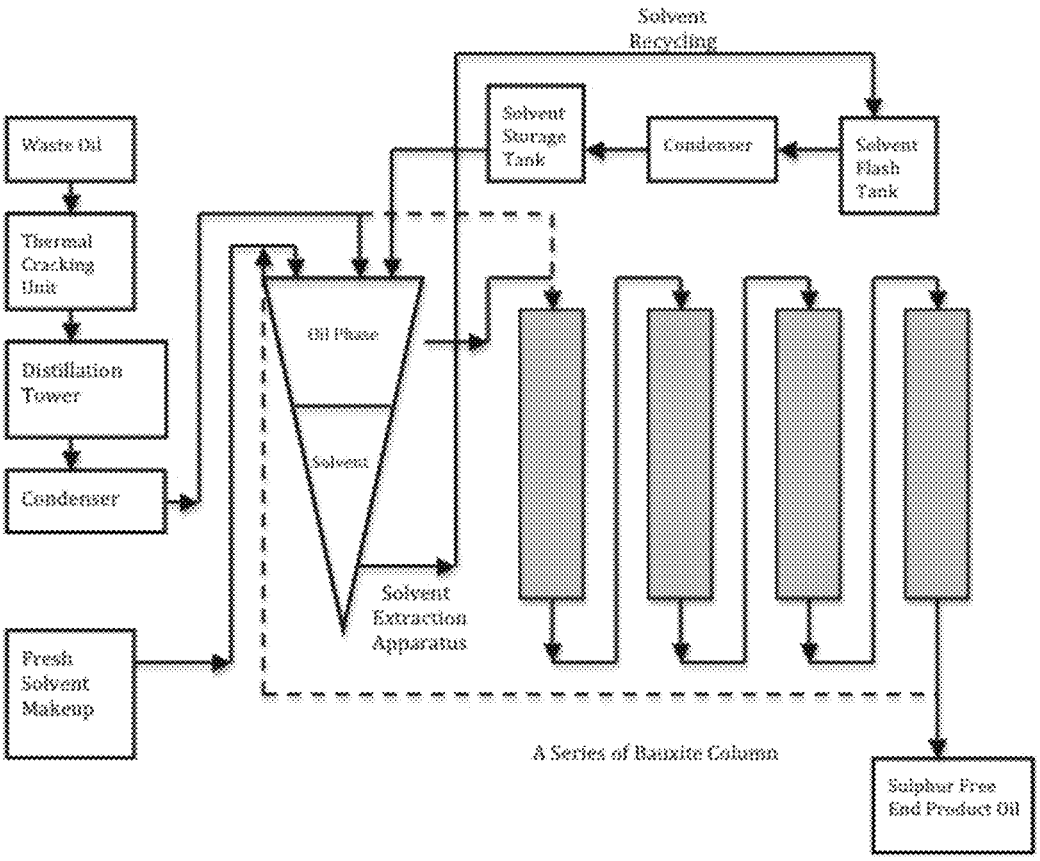
Solvent
Recycling
Waste Oil
Thermal
Cracking
Unit
Distillation
Tower
Condenser
Fresh
Solvent
Makeup
Solvent
Storage
Tank
Condenser
Solvent
Flash
Tank
Oil Phase
Solvent
Solvent
Extraction
Apparatus
A Series of Bauxite Column
Sulphur Free
End Product Oil

METHOD FOR REMOVING SULFUR-CONTAINING CONTAMINANTS FROM A THERMALLY CRACKED WASTE OIL

BACKGROUND

Field

The present invention relates to a method for removing sulfur containing contaminants from thermally cracked waste oils, and more particularly, to a method for removing sulfur containing contaminants from thermally cracked oils such as waste engine oil, metal cutting oil and hydraulic oils

Description of Related Art

A variety of processes have been developed for production of diesel fuel from waste oils such as used engine oils and hydraulic oils by thermal cracking process. However, regardless of the processes of the technologies developed so far, the thermal cracking process itself gives rise to unavoidable problems related with quality of the end product oil. The end product oil has a strong odor, which is mostly generated from sulfur compounds, and dark tar precipitates, which is originated from oxidation, and the oil becomes darkened as it ages. These problems give rise to questions on the process itself and marketability of the end product oil.

Methanol has been widely tried to remove sulfur containing compounds, while acetone has been seldom used. Selective removal of sulfur containing contaminants from thermally cracked waste oil is found to be impossible with a method using one particular solvent extraction process. No literatures are found to have employed combination of solvent extraction process and adsorption process.

U.S. Pat. No. 5,855,768 to Stanciulescu et al. discloses that 95% of tar is removed by methanol extraction method with removal rate of 60% sulfur, 90% nitrogen and 60% chlorine. The temperature employed was between room temperature and 60° C., which is below the boiling point of methanol. It is well described by Stanciulescu et al. that the thermal cracking process produces olefin-rich oil, which itself rapidly changes color and the composition through oxidation and polymerization reactions.

This is also pointed out in "A literature review on fuel stability studies with particular emphasis on diesel fuel", Energy & Fuels, vol. 5, 2, 1991, written by Balts, B. D. and Fathoni, A. Z. This paper gives full explanation on the tendency of thermally cracked distillates, which deteriorates more rapidly than straight run distillates during storage. Also, cracked product oils induce gum and sediment formation in fuels. It discloses that major causes of gum or sediment formation include oxidation, auto-oxidation, and chemical reactions such as polymerization involving unsaturated hydrocarbons and/or reactive organic compounds including sulfur, nitrogen and oxygen present in fuels.

The article "Influence of methanol extraction on the stability of middle distillate fuels" in Fuel, 73(2), 269-271 (1994), written by Sharma, Y. K, and Agrawal, K. M., also describes about methanol extraction. Its research data shows that middle distillate extracted with methanol shows much less insolubles, which supports the effective removal of insoluble precursors.

Wecher, M. A. and Hardy, D. R. studied methanol extraction in "The isolation of precursors responsible for insolubles formation in mid-distillate diesel fuels" in Fuel Science and Technology International, 7(4), 423-441 (1989).

It discloses that when mid-distillate diesel fuel is subject to solvent extraction using methanol, insolubles in the fuel are reduced dramatically, with more than 95% of the fuel insolubles being soluble in methanol.

A variety of methods are found in the art, which describe the de-colorization of aromatic hydrocarbon streams.

U.S. Pat. No. 2,596,942 issued to Donald W Robertson et al. describes reduction of color of petroleum stocks such as oils and waves, by filteration with bauxite.

Another method teaching removal of colored impurities is disclosed in U.S. Pat. No. 3,835,037, which describes removal of color bodies from mixed hydrocarbon feedstock containing naphthalene by contacting with clay to polymerize the impurities. Distillation always follows this clay treatment to separate polymerized impurities.

U.S. Pat. No. 4,423,278 issued to Kang et al. discloses that color may be removed from colored polyphenylated alkane by contacting it with certain adsorbents. The adsorbents comprise certain crystalline zeolites in a silica alumina matrix and bauxite clay having at least one material selected from the group consisting of ferric oxide, titanium oxide, and zirconium oxide, which is activated by sulfuric acid and then calcined to provide the effective adsorbents.

SUMMARY

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

In accordance with an illustrative example, there is provided a method for removing sulfur-containing contaminants from a thermally cracked waste oil comprising the steps of: mixing the thermally cracked waste oil with a solvent; extracting first sulfur-containing contaminants within the thermally cracked waste oil into the solvent; filtering an oil phase of the thermally cracked waste oil through bauxite columns; extracting second sulfur-containing contaminants within the oil phase filtered through the bauxite columns into the solvent; and separating the solvent containing the first and the second sulfur-containing contaminants from the oil phase.

Other features and aspects may be apparent from the following detailed description, the drawings, and the claims.

BRIEF DESCRIPTION OF THE DRAWINGS

These and/or other aspects will become apparent and more readily appreciated from the following description of the embodiments, taken in conjunction with the accompanying drawings in which:

FIG. 1 shows a flow diagram of the sulfur containing contaminant removal process that employs acetone/methanol extraction and adsorption with bauxite according to the embodiment of the present invention.

Throughout the drawings and the detailed description, unless otherwise described, the same drawing reference numerals will be understood to refer to the same elements, features, and structures. The relative size and depiction of these elements may be exaggerated for clarity, illustration, and convenience.

DETAILED DESCRIPTION

The following detailed description is provided to assist the reader in gaining a comprehensive understanding of the methods, apparatuses, and/or systems described herein. Accordingly, various changes, modifications, and equivalents of the systems, apparatuses and/or methods described herein will be suggested to those of ordinary skill in the art. Also, descriptions of well-known functions and constructions may be omitted for increased clarity and conciseness. In the drawings, the shapes and dimensions of elements may be exaggerated for clarity, and the same reference numerals will be used throughout to designate the same or like elements.

The terminology used herein is for the purpose of describing particular embodiments only and is not intended to be limiting of the illustrative configurations. As used herein, the singular forms "a," "an" and "the" are intended to include the plural forms as well, unless the context clearly indicates otherwise.

It has been found from the present invention that the contaminants containing sulfur and nitrogen from the thermally cracked distillates may readily and totally be removed at 50-70° C. and at atmospheric pressure. In the present invention, the substantial amount of contaminants containing sulfur and nitrogen is separated into the solvent and the further remaining contaminants can be separated via adsorption with bauxite. The solvent phase can be subject to flash evaporation and then be recycled.

Conventionally, the solvent extraction must be carried out within short period of time after thermal cracking process, preferably within 24 hrs. However, compared to the conventional technologies, it is confirmed from the present invention that leaving the thermally cracked oils more than 6 hours at room temperature makes the solvent extraction process more difficult or ineffective at all. By employing the solvent extraction within short period of time after the thermal cracking process, preferably within 0-20 min, substantial amount of sulfur containing contaminants could be removed after a series of repetitive extractions.

The solvent may be an acetone or a mixture of an acetone and a methanol. Where the solvent is acetone, it may have 100% purity. Where the solvent is a mixture of an acetone and a methanol, a ratio of acetone:methanol in the mixture is 80:20 by volume.

The extracting of the first sulfur-containing contaminants within the thermally cracked waste oil may be carried out for a solvent and the thermally cracked oil at a ratio of 50:50 by volume. The extracting of the second sulfur-containing contaminants within the oil phase filtered through the bauxite columns may be carried out for a mixture of solvent and the oil phase at a same volume ratio of 50:50. Then, the oil phase may go through a series of column filled with bauxite. The temperature range of thermally cracked oil from the cracking pot is between 50-70° C., preferably 55-60° C., which is just right temperature range for these solvent extractions.

The extracting may be conducted in a stainless steel vessel equipped with a blending blade for 30-60 min, which is enough for clear separation.

The result of using the solvent extraction process produces better quality of oil, but with still 15-20% sulfur containing contaminants in the oil phase. However, the sulfur contents drops to 80-85%, the nitrogen contents drops to 90-96%, and the tar contents decreases by 97-98%, which is 2-3 times better rate than that of conventional solvent extraction process.

Preferred embodiments will be described with reference to the accompanying drawing. Referring to FIG. 1, waste oils such as engine oil, metal cutting oil and hydraulic oils are thermally cracked in a thermal cracking unit. The thermally cracked oil is collected using a distillation tower and a condenser, and then is transferred into a solvent extraction vessel. Fresh solvent makeup such as acetone or mixture of acetone and methanol may be pumped into the extraction vessel. This fresh makeup compensates the loss of the solvent during the extracting step, because about 0.2% of the solvent used in the extraction vessel is mixed with oil phase and cannot be recovered.

Recycled 98% solvent is also pumped into the extraction vessel. The temperature range of the thermally cracked oil at the end of the condenser is about 65-75° C. The temperature of the vessel usually drops a little bit as the fresh or recycled solvent is pumped into vessel. Therefore, the extraction temperature ranges around 55-60° C. which is favorable temperature. Another option could be using a preheating heating coil wound around a solvent supply line when solvent is pumped into the vessel. Within the vessel, the first extraction process is performed. The desirable pressure within the vessel is atmospheric. Pressurization of the vessel does not improve sulfur removal rate at all. The volume ratio of methanol and cracked oil is 50:50. To keep the amount of solvent within the extraction vessel constant, fresh solvent is supplied to the vessel from a fresh solvent makeup.

After the first extraction process, the resulting solvent phase is transferred to solvent flash tank and then recycled through a condenser to storage tank, which prevents any loss of hazardous solvent fume into the atmosphere.

In the solvent flash tank, sulfur containing contaminants are separated from the solvent liquid phase by a simple flash evaporation and then discharged as a sludge cake. The operating temperature range of the solvent flash tank is 70-80° C. and the condenser operates at below 45° C. with the help of vacuum pump.

This process can be performed only one or two times, or, preferably, repeated at least three times in the same manner to make sure of possible sulfur removal from the cracked oil.

Then, the cleaned oil is cooled down to room temperature (25° C.) and sent by a pump into a serious of bauxite for adsorption process to remove any contaminants with colors. The bauxite may be an activated bauxite, which has a high aluminum oxide content and a high surface area. Preferably, slow pumping is necessary in order to maximize residence time of oil in the bauxite column and to maximize adsorption rate. Preferably, the residence time of the oil in the series of columns may be about 10-12 hrs.

Table 1 shows typical chemical analysis of an example of the thermally cracked waste oil before applying the method according to the present invention and the product oil after applying the method according to the present invention.

TABLE 1

| | Waste Oil | Product Oil |
|---|---|---|
| Water (%) | 6.00 | 0.05 |
| Ash (%) | 2.49 | <0.01 |
| Sulfur (%) | 0.079 | <0.0005 |
| Carbon (%) | 83.45 | 82.88 |
| Hydrogen (%) | 13.98 | 12.36 |
| Nitrogen (ppm) | 491 | 98.34 |
| Specific gravity, 24/25° C. | 0.923 | 0.814 |
| Specific gravity, 15/15° C. | 0.907 | 0.803 |
| Ignition point (° C.) | 42 | 36 |
| Density - API | 24.19 | 41.12 |
| Heating Value (BTU/lb) | 18979 | 19622 |
| Color-ASTM | NA | 2.5 |

Chemical analysis and physical properties of bauxite are shown in Table 2.

TABLE 2

| | |
|---|---|
| $Al_2O_2$ | 92.50% |
| $TiO_2$ | 0.33 |
| $SiO_2$ | 2.75 |
| $Fe_2O_3$ | 3.99 |
| CaO | 0.00 |
| MgO | 0.05 |
| $Na_2O$ | 0.03 |
| $K_2O$ | 0.00 |
| L.O.I. on calcined basis | 6.32 |
| Bulk Density | 0.90 g/cm$^3$ |
| Moisture | 2.06% |
| Loss on Abrasion | 20.0% |
| BET surface area | 205 m$^2$/g |

Hereinafter, the resulting example of each process step will be described.

Example of the Sulfur Removal Process

The same sample from the extraction vessel has been used for EXAMPLES 1-5 below. 2 types of solvent are used for extraction process:Acetone only and mixture of acetone and methanol (8:2 by volume).

Example 1

Cracked oil goes through acetone extraction process (3 times) at 50-65° C. The resulting sulfur content is shown in table 3.

TABLE 3

| | Sulfur content, ppm |
|---|---|
| Cracked oil | 616 |
| 1$^{st}$ Extraction | 365 |
| 2$^{nd}$ Extraction | 230 |
| 3$^{rd}$ Extraction | 175 |

Example 2

Cracked oil goes through a serious of bauxite columns, and then acetone extraction process (3 times) at 50-65° C. The resulting sulfur content is shown in table 4.

TABLE 4

| | Sulfur content, ppm |
|---|---|
| Cracked oil | 616 |
| Adsorption with Bauxite | 179 |
| 1$^{st}$ Extraction | 81 |
| 2$^{nd}$ Extraction | 50 |
| 3$^{rd}$ Extraction | 43 |

Example 3

Cracked oil goes through acetone/methanol (80:20) mixture extraction process (3 times) at 50-65° C. The resulting sulfur content is as follows:

TABLE 5

| | Sulfur content, ppm |
|---|---|
| Cracked oil | 616 |
| 1$^{st}$ Extraction | 327 |
| 2$^{nd}$ Extraction | 200 |
| 3$^{rd}$ Extraction | 152 |

Example 4

Cracked oil goes through a series of bauxite columns, and then acetone/methanol (8:2) mixture extraction process at 50-65° C. The resulting sulfur content is as follows:

TABLE 6

| | Sulfur content, ppm |
|---|---|
| Cracked oil | 616 |
| Adsorption with Bauxite | 179 |
| 1$^{st}$ Extraction | 69 |
| 2$^{nd}$ Extraction | 53 |
| 3$^{rd}$ Extraction | <5 |

Example 5

Cracked oil goes through acetone/methanol (8:2) extraction processes (3 times) at 50-65° C., and then a series of bauxite columns. The resulting sulfur content is as follows:

TABLE 6

| | Sulfur content, ppm |
|---|---|
| Cracked oil | 616 |
| 1$^{st}$ Extraction | 81 |
| 2$^{nd}$ Extraction | 50 |
| 3$^{rd}$ Extraction | 41 |
| Adsorption with Bauxite | <5 |

Unless otherwise defined, all terms (including technical and scientific terms) used herein have the same meaning as commonly understood by one of ordinary skill in the relevant art. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Also, example configurations are described above with reference to cross-sectional illustrations that are schematic illustrations of idealized configurations (and intermediate structures). As such, variations from the shapes of the illustrations as a result, for example, of manufacturing techniques and/or tolerances, are to be expected. Thus, example configurations or embodiments should not be construed as limited to the particular shapes of regions illustrated herein but are to include deviations in shapes that result, for example, from manufacturing. The regions illustrated in the figures are schematic in nature and their shapes are not intended to illustrate the actual shape of a region of a device and are not intended to limit the scope of the configurations or embodiments.

Furthermore, it will be understood that, although the terms first, second, third, and fourth may be used herein to describe various elements, components, regions, parts and/or sections, these elements, components, regions, parts and/or sections should not be limited by these terms. These terms are only used to distinguish one element, component, region, part or section from another region, part or section. These terms do not necessarily imply a specific order or arrangement of the elements, components, regions, parts and/or sections. Thus, a first element, component, region, part or section discussed below could be termed a second element, component, region, part or section without departing from the descriptions of the various embodiments or configurations described above.

A number of examples have been described above. Nevertheless, it will be understood that various modifications may be made. For example, suitable results may be achieved if the described techniques are performed in a different order and/or if components in a described system, architecture, device, or circuit are combined in a different manner and/or replaced or supplemented by other components or their equivalents. Accordingly, other implementations are within the scope of the following claims.

What is claimed is:

1. A method for removing sulfur-containing contaminants from a thermally cracked waste oil comprising the steps of:

mixing the thermally cracked waste oil with a solvent;

extracting first sulfur-containing contaminants within the thermally cracked waste oil into the solvent;

filtering an oil phase of the thermally cracked waste oil through bauxite columns;

extracting second sulfur-containing contaminants within the oil phase filtered through the bauxite columns into the solvent; and separating the solvent containing the first and the second sulfur-containing contaminants from the oil phase.

2. The method of claim 1, wherein the solvent is an acetone or a mixture of an acetone and a methanol.

3. The method of claim 2, wherein the acetone has 100% purity.

4. The method of claim 1, further comprising steps of:

applying a flash evaporation to the solvent containing the first and the second sulfur-containing contaminants, thereby separating the first and the second sulfur-containing contaminants from the solvent to obtain a recycled solvent; and reusing the recycled solvent for the step of the mixing the thermally cracked waste oil with the solvent.

5. The method of claim 1, wherein the extracting the first sulfur-containing contaminants is repeated at least three times.

6. The method of claim 2, wherein a ratio of acetone: methanol in the mixture is 80:20 by volume.

7. The method of claim 1, wherein a temperature for the extracting ranges 50-70° C.

8. The method of claim 1, wherein a temperature for the extracting ranges 55-60° C.

9. The method of claim 1, wherein the thermally cracked waste oil comprises engine oil, metal cutting oil, hydraulic oil, or a mixture thereof.

10. The method of claim 1, wherein the extracting is conducted in an atmospheric pressure.

11. The method of claim 1, wherein a volume ratio of the solvent and the thermally cracked waste oil is 50:50.

12. The method of claim 1, wherein a volume ratio of the solvent and the oil phase is 50:50.

13. The method of claim 1, wherein the mixing is conducted 0-20 min after a thermal cracking of a waste oil.

14. The method of claim 1, wherein the extracting is conducted for 30-60 min.

15. The method of claim 4, wherein the flash evaporation comprises:

condensing the solvent containing the first and the second sulfur-containing contaminants;

separating a sludge cake from the condensed solvent; and discharging the sludge cake.

16. The method of claim 4, wherein a temperature of the solvent at the end of the condensing ranges 65-75° C.

17. The method of claim 1, further comprising:

cooling the oil phase to a room temperature; and pumping the oil phase into the bauxite columns.

18. The method of claim 17, wherein the pumping is adjusted such that a residence time of the oil phase within the bauxite columns is maintained at about 10-12 hrs.

* * * * *